United States Patent [19]

Brenner

[11] Patent Number: 4,930,603

[45] Date of Patent: Jun. 5, 1990

[54] METHOD AND APPARATUS FOR SERVING THE PASSENGER TRAFFIC AT A MAIN FLOOR OF AN ELEVATOR INSTALLATION

[75] Inventor: Richard Brenner, Stansstad, Switzerland

[73] Assignee: Inventio AG, Switzerland

[21] Appl. No.: 296,536

[22] Filed: Jan. 12, 1989

[30] Foreign Application Priority Data

Jan. 14, 1988 [CH] Switzerland ..... 00108/88-4

[51] Int. Cl.[5] ..... B66B 1/20

[52] U.S. Cl. ..... 187/125

[58] Field of Search ..... 187/101, 124, 125, 131

[56] References Cited

U.S. PATENT DOCUMENTS

| | | | |
|---|---|---|---|
| 3,422,928 | 1/1969 | Bruns | 187/125 |
| 4,058,187 | 11/1977 | Jacoby et al. | 187/125 |
| 4,112,419 | 9/1978 | Kinoshita et al. | 187/131 X |
| 4,305,479 | 12/1981 | Bittar et al. | 187/125 |
| 4,553,639 | 11/1985 | Uetani | 187/131 |
| 4,846,311 | 7/1989 | Thangavelu | 187/125 |

FOREIGN PATENT DOCUMENTS 0030163 6/1981 European Pat. Off. .

2136157 9/1984 United Kingdom .

*Primary Examiner*—A. D. Pellinen
*Assistant Examiner*—W. E. Duncanson, Jr.
*Attorney, Agent, or Firm*—Marshall & Melhorn

[57] ABSTRACT

A method and apparatus for the control of the dispatch of elevator cars from the main floor are implemented in a plurality of algorithms performed by a process computer. A first algorithm for an elevator group receives data representing the measured arriving and departing building filling passenger traffic from sensors. The first algorithm determines the traffic requirements and the actual departure load of the elevator group from this data and various constants, and determines the transport capacity of the elevator group. The transport capacity is assigned to second algorithms associated with the elevator cars and corresponding to the nominal load of each respective car. Based upon the assigned transport capacity and the round trip time of the respective elevator car, the second algorithm calculates the nominal departure load. Dependent on the nominal departure load and the actual departure load, the second algorithm calculates a corrected departure load with which the elevator car should be loaded.

33 Claims, 5 Drawing Sheets

FIG. 5

| | |
|---|---|
| | READJUST DEPARTURE LOAD ASL |
| S1 | CALCULATE DEPARTURE LOAD ERROR $SLE = UT - LFB$ |
| S2 | CALCULATE NEW CALCULATED DEPARTURE LOAD ERROR $CLE = CLE_{ALT} + SLE$ |
| S3 | CALCULATE PROPORTIONAL SHARE $PPA = GAN \cdot SLE$ |
| S4 | CALCULATE INTEGRAL SHARE $IPA = \frac{GAN \cdot ST \cdot CLE}{INT}$ |
| S5 | CALCULATE CORRECTED DEPARTURE LOAD $ASL = PPA + IPA$ |

FIG. 6

| | |
|---|---|
| | READJUST DEPARTURE LOAD ASL. x |
| S1 | CALCULATE DEPARTURE LOAD ERROR $SLE.x = SL.x - LFB.x$ |
| S2 | CALCULATE NEW CALCULATED DEPARTURE LOAD ERROR $CLE.x \quad CLE.x_{ALT} + SLE.x$ |
| S3 | CALCULATE PROPORTIONAL SHARE $PPA.x = GAN.x \cdot SLE.x$ |
| S4 | CALCULATE INTEGRAL SHARE $IPA.x = \frac{GAN.x \cdot ST.x \cdot CLE.x}{INT.x}$ |
| S5 | CALCULATE CORRECTED DEPARTURE LOAD $ASL.x = PPA.x + IPA.x$ |

METHOD AND APPARATUS FOR SERVING THE PASSENGER TRAFFIC AT A MAIN FLOOR OF AN ELEVATOR INSTALLATION

BACKGROUND OF THE INVENTION

The present invention relates in general to a method and apparatus for the control of the dispatch of elevator cars from a main floor and, in particular, to such control dependent on the building-filling passenger traffic.

A dispatch control for an elevator group consisting of several elevators is shown in the European Patent No. 0 030 163, in which the dispatch interval is based on an approximate round trip time of an elevator car, or on a mean round trip time based on the three preceding, approximate round trip times. The round trip time is divided by the number of elevator cars serving the main floor to determine a mean dispatch time interval. The approximate round trip time is the expected time which the elevator car requires for the up trip, serving the car calls registered at the main floor and the return trip to the main floor, and is calculated from building parameters, elevator installation parameters and operating condition parameters. If the elevator car has reached less than half its nominal load after expiration of the calculated dispatch interval time, the calculated interval time for the cars available at the main floor is shortened. If the elevator car reaches, after expiration of the calculated dispatch time interval, at least half its nominal load, the interval time is shortened in a similar manner, however, with different weighting of the available cars.

A disadvantage of the above described control is that the actual dispatching time interval is determined on the basis of approximate round trip times calculated from past data. This permits, in the best case, an estimate of the dispatching interval necessary for serving the actual traffic requirements. A further drawback is the fact that the control distinguishes only between a departure load being smaller than half the nominal load, and a departure load which is at least equal to half the nominal load, and in doing so shortens the interval time based on the number of cars available at the main floor. There results again only an approximate matching with the effective variations of the traffic requirements. A consequence of both drawbacks is that the utilization of the elevator cars is not optimized.

SUMMARY OF THE INVENTION

The present invention solves the above described problem by creating a method in which the quantative and qualitative optimization of the building-filling passenger traffic is assured. The advantages attained by the invention are that the passenger traffic neither backs ups nor forms gaps at the main floor. The car work load is rated in such a way that the transport capacity of the elevator group and the actual traffic requirement are in equilibrium.

Another advantage is that in case of the breakdown of one or more elevator cars, the traffic capacity of the disabled cars is automatically assigned to the remaining elevator cars of the elevator group. A further advantage is that by the method according to the invention the transport capacity offerred at the main floor is matched to the transport demand, even in the case of non-upward peak traffic. A further advantage is the fact, that different nominal loads of the elevator cars are taken into consideration in the assignment of the transport capacity. A further advantage is the fact, that several elevator cars execute their orders, independently from each other. The traffic requirement at the main stop in this is determined centrally and accomplished decentrally by the elevator cars.

In an elevator group, each elevator car is driven by a hoisting machine supplied with electrical energy by a drive system. The drive system is controlled by an elevator control for the car which controls are connected to a process computer for the system. A terminal connected to the process computer permits entry of the values for various constants used in an algorithm controller implemented in the computer. A sensor at the main floor provides information to the computer on the passengers entering the system and each car is also provided with a sensor connected to its associated control for providing data on the passengers in the associated car.

The algorithm is implemented as a series of steps defining a method for controlling the dispatch of the cars.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which:

FIG. 5 is a flow chart of an algorithm for the elevator group for readjusting the departure load shown in FIG. 3; and FIG. 6 is a flow chart of an algorithm for the elevator car for readjusting the departure load shown in FIG. 4.

DESCRIPTION OF THE PREFERRED EMBODIMENT

The designations of the algorithm steps and the names of the devices in FIGS. 1 through 6, as well as the abbreviations of the constants, status variables, and variables set forth in the column "Memo-Code" of Table 1 below, are used as reference symbols. Table 1 is a listing of the constants, status variables, and variables involved in the method of operation according to the present invention. In FIGS. 1 through 6, reference symbols with and without indices are used. Not indexed reference symbols refer to the elevator groups consisting of "n" elevators. Reference symbols indexed with ".1, .2 . . . .n" refer to the elevators "1, 2 . . . n", respectively. A reference symbol indexed with ".x" refers to one of the elevators "1, 2 . . . n". Reference symbols indexed with the capital letters ".A, .B . . . .N" refer to the sensors "A, B . . . N" respectively. A reference symbol indexed with ".X" refers to one of the sensors "A, B . . . N". Some of the steps shown in FIGS. 3 and 4 require a determination whether constants, status variables or variables satisfy the triangularly shaped stated conditions. A positive result of a determination is characterized with the reference symbol "Y" and a negative result of a determination is characterized with the reference symbol "N" in each respective step.

TABLE 1

| Memo-Code | Constant |
|---|---|
| CF | calibrating factor |
| DT | door opening time |
| GAN | amplification factor |
| INT | integration time |
| IPA | integral share |
| LC | total nominal load |
| LS | load share |
| NOC | number of elevators |
| PPA | proportional share |
| ST | scanning time |
| SRT | statistical round trip time |
| **Memo-Code** | **Status variable** |
| CA | elevator arrival |
| CS | elevator start |
| DC | door closing command |
| **Memo-Code** | **Variable** |
| ART | average round trip time |
| ASL | corrected total departure load |
| CR | number of trips |
| CLE | calculated departure load error |
| LFB | actual departure load |
| PTC | transport capacity per load share |
| RT | round trip time |
| SL | nominal departure load |
| SLE | departure load error |
| TC | transport capacity |
| TCE | transport capacity error |
| TTC | total transport capacity |
| UT | traffic requirement |

Figure 1:
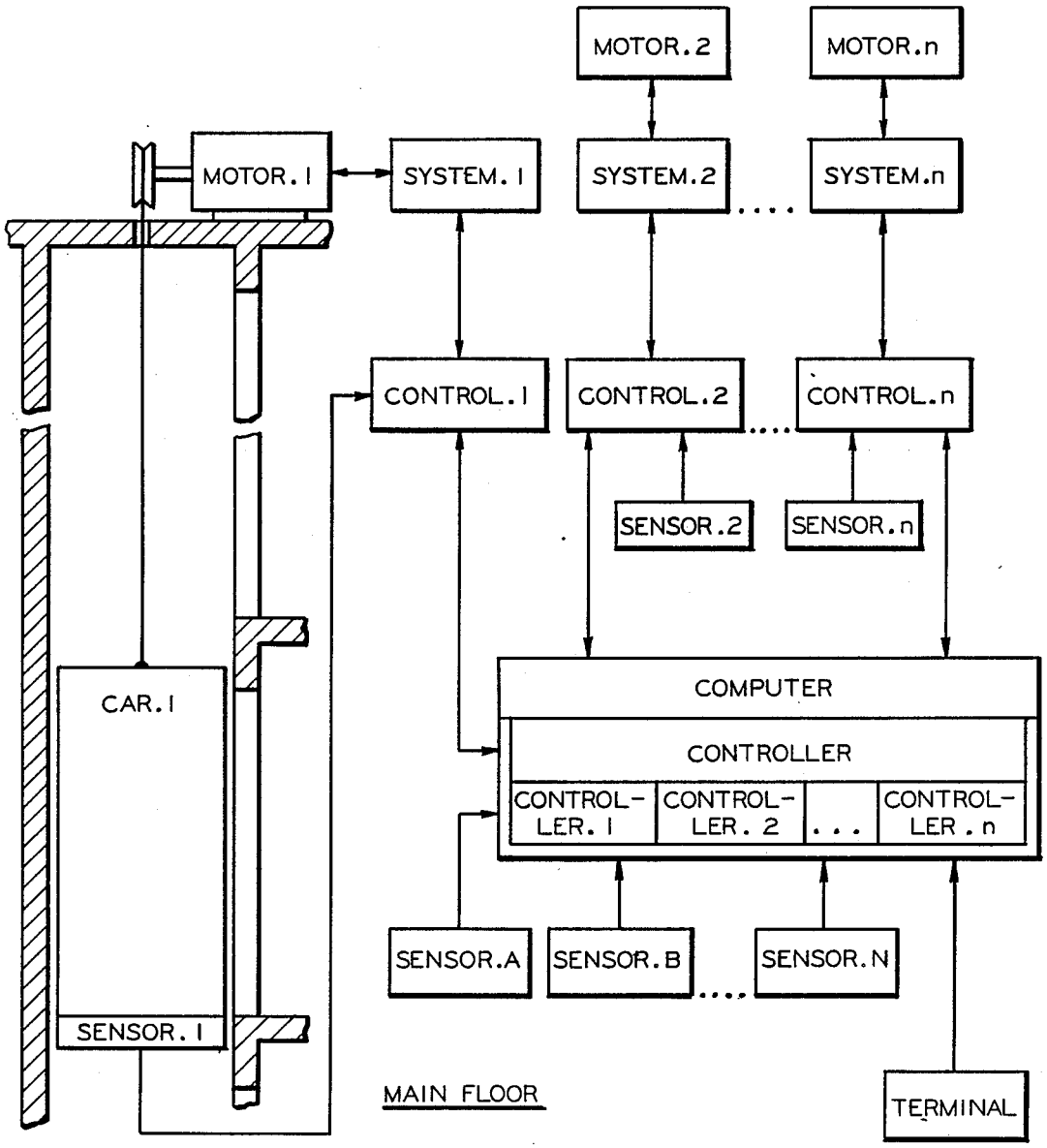
FIG. 1 is a schematic block diagram presentation of an elevator group utilizing the method according to the present invention.

Shown in FIG. 1 is an elevator group consisting of "n" elevators. A hoisting machine MOTOR.1 drives an elevator car CAR.1 of the first elevator. The hoisting machine MOTOR.1 is supplied with electrical energy by a drive system SYSTEM.1, which system is connected to and controlled by an elevator control CONTROL.1. The detection of the building-filling passenger traffic departing from a main floor MAIN FLOOR and entering the first elevator car is made by load measuring devices or passenger counting devices, such as a sensor SENSOR.1 mounted in the elevator car CAR.1. The sensor SENSOR.1 is connected with and sends its signal to the elevator control CONTROL.1. The elevators two through "n", with hoisting machines MOTOR.2, MOTOR.3 . . . MOTOR.n, drive systems SYSTEM.2, SYSTEM.3 . . . SYSTEM.n, elevator controls CONTROL.2, CONTROL.3 . . . CONTROL.n, sensors SENSOR.2, SENSOR.3 . . . SENSOR.n, and elevator cars CAR.2, CAR.3 . . . CAR.n (not shown) correspond in their construction and in their mode of operation to the first elevator described above.

Sensors SENSOR.A, SENSOR.B . . . SENSOR N located at the main floor MAIN FLOOR detect the arriving building-filling passenger traffic and are connected to a process computer which in turn is connected with the elevator controls CONTROL.1, CONTROL.2 . . . CONTROL.n and with an input/output unit TERMINAL. An algorithm CONTROLLER and subordinated algorithms CONTROLLER.1, CONTROLLER.2 . . . CONTROLLER .n, implemented in the process computer as, for example, a computer program and subroutines, control the dispatch of the elevator cars CAR.1, CAR.2 . . . CAR.n.

Figure 2:
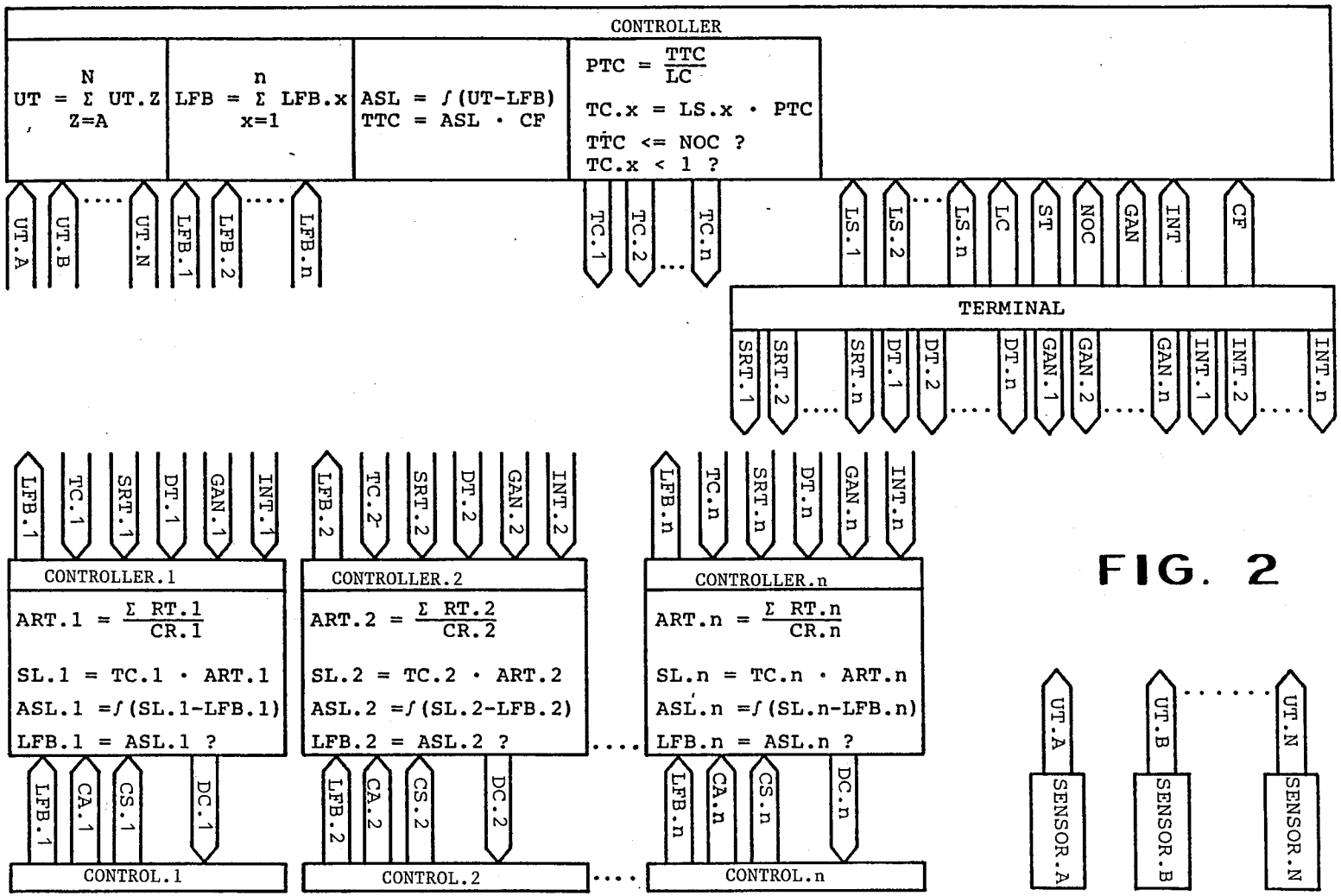
FIG. 2 is a schematic presentation of the data sources and data sinks for the elevator group of FIG. 1.

Shown in FIG. 2 are the algorithm CONTROLLER implemented in the process computer and the data sources (inputs) and data sinks (outputs) connected to the process computer and utilized in the method according to the present invention. Provided at the main floor MAIN FLOOR for the detection of the arriving building-filling passenger traffic are, as variants of the sensors SENSOR.A, SENSOR.B . . . Sensor.N, light barriers, turnstiles, infrared detectors, field detectors or call registering devices, each of which generates a traffic requirement signal UT.X. The building-filling passenger traffic originating at the main floor MAIN FLOOR and entering the departing the cars is detected by the sensors SENSOR.1, SENSOR.2 . . . SENSOR.n, mounted in the elevator cars CAR.1, CAR.2 . . . CAR.n respectively, and that information is sent to the elevator controls CONTROL.1, CONTROL.2 . . . CONTROL.n respectively.

Constants required in the method according to the present invention can be chosen and communicated to the algorithm CONTROLLER by means of the input/output unit TERMINAL. The first elevator control CONTROL.1 is connected with the first subordinated algorithm CONTROLLER.1, the second elevator control CONTROL.2 is connected with the second subordinated algorithm CONTROLLER.2, and so on through the nth elevator control CONTROL.n. The algorithms CONTROLLER.1, CONTROLLER.2 . . . CONTROLLER.n as well as their input and output data are identical.

There is also shown in FIG. 2 the steps of the method according to the present invention. In a first block of the step sequence of the algorithm CONTROLLER, traffic requirements UT.A, UT.B . . . UT.N, detected by the sensors SENSOR.A, SENSOR.B . . . SENSOR.N respectively, are processed by summing into a total traffic requirement UT for the elevator group. Actual departure loads LFB.1, LFB.2 . . . LFB.n, detected by the sensors SENSOR.1, SENSOR.2 . . . SENSOR.n respectively, are processed by summing into a total actual departure load LFB for the elevator group as shown in a second block. In a third block, the algorithm CONTROLLER controls, with a proportional integral and differential control characteristic from the total traffic requirement UT and the total actual departure load LFB, a corrected total departure load ASL, from which a total transport capacity TTC is derived for the elevator group by multiplying by a calibrating factor CF.

In a fourth block of the algorithm CONTROLLER, a transport capacity per load share PTC results from the division of the total transport capacity TTC by a total nominal load LC of the elevator group. A transport capacity TC.x is determined for each of the respective elevator cars CAR.x by multiplying the transport capacity per load share PTC by a load share LS.x. Prior to the assignment of the transport capacities TC.1, TC.2 . . . TC.n to the subordinated algorithms CONTROLLER.1, CONTROLLER.2 . . . CONTROLLER.n respectively, the algorithm CONTROLLER checks whether the total transport capacity TTC is sufficiently large for an assignment depending on the nominal load (whether TTC is less than or equal to the number of elevators NOC) and whether the transport capacity TC.x dependent on the nominal load is at least one. Depending on the result of the test, the algorithm CONTROLLER assigns the transport capacity TC.x a value calculated from the total transport capacity TTC, or a previously determined transport capacity value. The values of the constants load share LS.x, total nominal load LC, scanning time ST, number of elevators NOC, amplification factor GAN, integration time INT and calibrating factor CF can be inputted by way of the input/output unit TERMINAL.

The algorithm CONTROLLER.x determines for every trip a round trip time RT.x and increases a number of trips CR.x by one. Accordingly, an average round trip time ART.x is calculated from the sum of the previous round trip times divided by the number of trips. The average round trip time ART.x is multiplied by the transport capacity TC.x to obtain a nominal departure load SL.x for the respective elevator car CAR.x. In a further step, the subordinated algorithm CONTROLLER.x controls, with a proportional integral and differential control characteristic, a corrected total departure load ASL.x from the difference between the nominal departure load SL.x and the actual departure load LFB.x. During the loading of the respective elevator car CAR.x, the subordinated algorithm CONTROLLER.x continously compares the actual departure load LFB.x with the corrected total departure load ASL.x. On attaining the corrected total departure load ASL.x value, or after expiration of a predetermined door opening time DT.x, a door closing command DC.x is generated from the subordinated algorithm CONTROLLER.x to the associated elevator control CONTROL.x. The constants door opening time DT.x, statistical round trip time SRT.x, amplification factor GAN.x, and integration time INT.x; the status variables elevator arrival CA.x and elevator start CS.x; and the variable actual departure load LFB.x are received as data from the input/output unit TERMINAL and from the elevator control CONTROL.x. The actual departure load LFB.x is generated from the subordinated algorithm CONTROLLER.x to the superimposed algorithm CONTROLLER for further processing.

Figure 3:
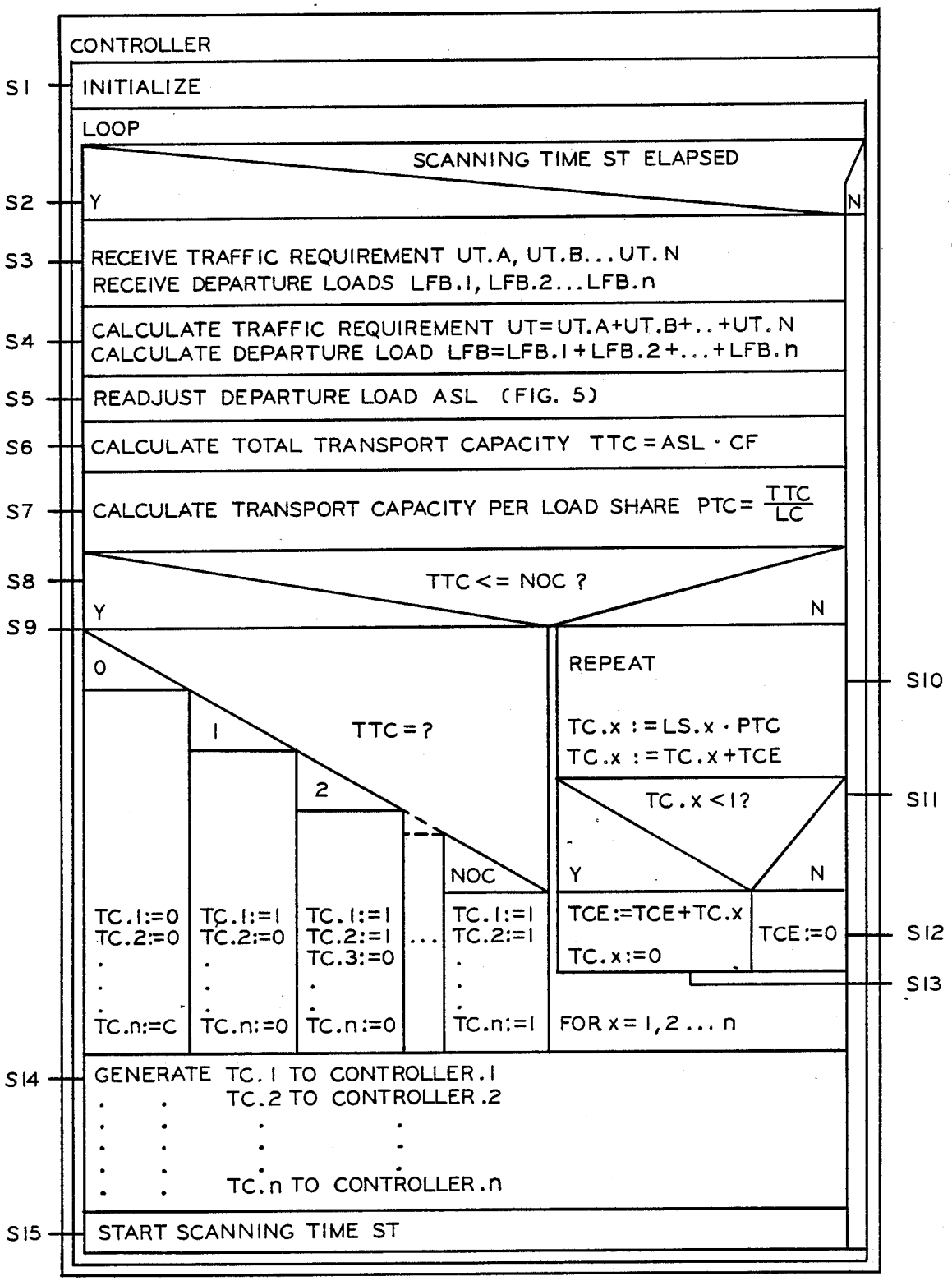
FIG. 3 is a flow chart of an algorithm for the control of the elevator group of FIG. 1.

FIG. 3 shows the structure and the sequence of the superimposed algorithm CONTROLLER. In a step S1, all constants and variables used in the algorithm CONTROLLER are initialized. The determination of the transport capacity is performed in a loop which starts with a step S2 in which it is checked whether the constant scanning time ST, received from the input/out unit TERMINAL, has expired. A positive result of the check branches at "Y" and enters into a step S3 wherein the traffic requirements UT.X are received from the sensors SENSOR.X and the departure loads LFB.x are received from the algorithm CONTROLLER.x. In a step S4, the total traffic requirement UT and the total actual departure load LFB are calculated for the elevator group. The control process for the correction of the total departure load ASL is performed in a step S5 which is explained in more detail in FIG. 5.

The departure load ASL is multiplied by the calibrating factor CF in a step S6 to yield the total transport capacity TTC for the elevator group. The nominal, load-dependent distribution of the total transport capacity TTC to the subordinated algorithms CONTROLLER.1, CONTROLLER.2 . . . CONTROLLER.n takes place in steps S7 through S13. The transport capacity per load share PTC is calculated in the step S7 by dividing the total transport capacity TTC by the total nominal load LC of the elevator group. In the step S8, it is checked whether the total transport capacity TTC is smaller or equal to the number of elevators NOC. A positive result of the test branches at "Y" into a selection procedure presented in the step S9. The total transport capacity TTC is divided independently of the nominal load in such a manner that the transport capacities TC.1, TC.2 . . . TC. n are at most one. The symbol ":=" is used to indicate that the variable on the left side of the symbol assumes the value of the variable on the right side of the symbol. If, for example, the total transport capacity TTC has a value of two, one passenger each is assigned to the transport capacity TC.1 and to the transport capacity TC.2. The remaining transport capacities TC.3, TC.4 . . . TC. n are set to zero respectively as no transport capacity is assigned. A negative result of the test performed in the step S8 branches at "N" into an iteration procedure "REPEAT", presented in the steps S10 through S13, which is repeated once for the calculation of each of the transport capacities TC.1, TC.2 . . . TC.n.

In the step S10, the transport capacity TC.x is set equal to the product of the load share LS.x and the transport capacity per load share PTC of the respective elevator car CAR.x. Subsequently, a transport capacity error TCE is added to the calculated transport capacity TC.x. In the step S11, it is checked whether the transport capacity TC.x to be assigned to the respective elevator car CAR.x is smaller than one. A positive result of this test branches to the step S13. The value of the transport capacity calculated in the step S10 is added to the prevailing value of the transport capacity error TCE to produce a new value for the transport capacity error TCE. Subsequently, the transport capacity TC.x assumes the value zero. The step S13 is always of importance in the case when nominal load-dependent transport capacities exist which are smaller than one and therefore cannot be served. At low traffic requirement and unfavorable nominal load/load share conditions, there exists the possibility that a transport capacity TC.x smaller than one will result from each transport capacity calculation. This would result in a non-assignment of the passenger calls registered at the main floor MAIN FLOOR. For this reason, transport capacities TC.x which are smaller than one are added to the variable transport capacity error TCE in the step S13 and, if need be, are summed and considered in the subsequent calculation of the transport capacity TC.x.

A negative result of the check carried out in the step S11 branches to the step S12 wherein the transport capacity error TCE is reset to zero. After "n" repetitions of the steps S10 through S13, the iteration procedure is terminated. The transport capacities TC.x resulting from the step S9 or from the steps S10 through S13 are generated to the subordinated algorithms CONTROLLER.x. With the start of the scanning time ST in a step S15, a cycle of the superimposed algorithm CONTROLLER is terminated. A subsequent cycle is initiated as soon as the scanning time ST has elapsed.

Figure 4:
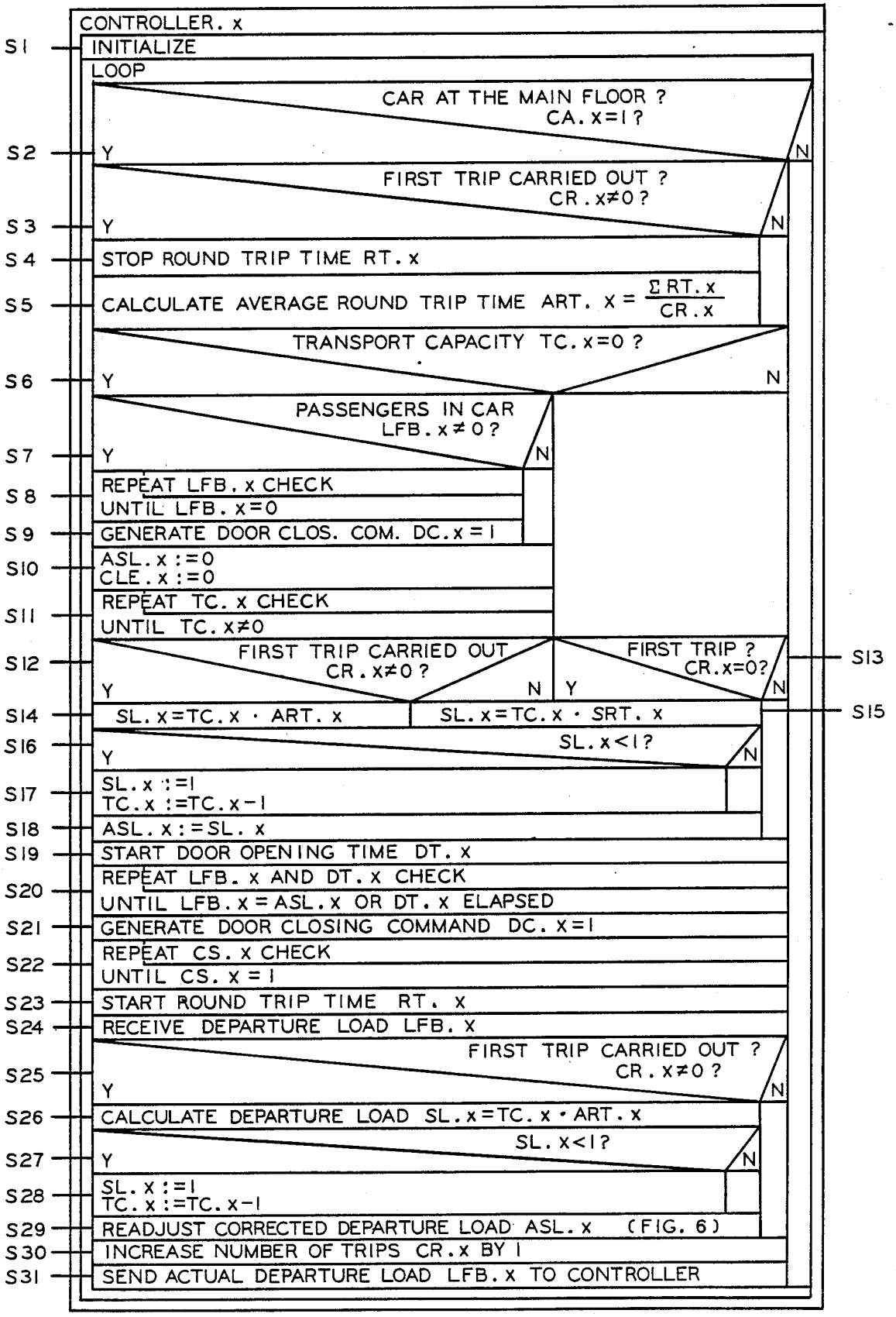
FIG. 4 is a flow chart of the algorithm for the control of an elevator car of the elevator group of FIG. 1.

FIG. 4 shows the structure and the sequence of the subordinated algorithms CONTROLLER.x. In a step S1, all constants, status variables and variables used in the subordinated algorithm CONTROLLER.x are initialized. A loop is begun and, as shown in a step S2, the subordinated algorithm CONTROLLER.x is activated with the arrival of the respective elevator car CAR.x at the main floor MAIN FLOOR. The arrival is checked by means of the status variable elevator arrival CA.x received from the elevator control CONTROL.x. A positive result of the test branches to a step S3 in which it is determined whether the respective elevator car CAR.x has taken its first trip, or whether it has already been incorporated in the normal elevator operation. A positive result of the test branches to a step S4. A negative result of the test branches the start of the first trip to a step S6. First, the method for the execution of the first trip will be explained, subsequently the method for normal operation will be explained in more detail. If it is established, based on the test performed in the step S3, that the respective elevator car CAR.x has not made a first trip, the steps S4 and S5 are bypassed and the test shown in the step S6 is initiated. In the step S6, it is determined whether the subordinated algorithm CONTROLLER.x has obtained an assignment of transport capacity TC.x. A positive result of the test results in the normal operation. A negative result of the test branches to the step S13. If it is determined, based on the test performed in the step S13, that the elevator car CAR.x has not yet carried out a trip, the step S15 is performed, in which the calculation of the nominal departure load SL.x for the first trip is made by multiplying the assigned transport capacity TC.x and the statistically determined round trip time SRT.x.

The control and examination of the car loading is essentially performed in the execution of steps S16 through S24 which are explained in more detail in the process for normal operation. A negative result of the examination carried out in a step S25 branches to a step S30, in which the variable number of trips CR.x is increased by one from zero. Subsequently the actual departure load LFB.x, checked after the car loading, is sent to the superimposed algorithm CONTROLLER in a step S31. The procedure for the execution of the first trip for the subordinated algorithm CONTROLLER.x is now terminated.

The normal operation begins with the return of the respective elevator car CAR.x to the main floor MAIN FLOOR. The data generated from the first trip serves as an initial program loader for the determination of the variable values of the consecutive trips. The first car loading proceeds in a controlled manner and serves, together with the execution of the first trip, as a basis for the execution of the normal operation.

When the elevator car CAR.x returns to the main floor MAIN FLOOR in the step S2, the test carried out in step S3 turns out positive and the step S4 is initiated. The round trip time RT.x of the previous trip is terminated and the average round trip time ART.x is determined in the step S5 by dividing the sum of all round trip times RT.x by the number of trips CR.x. A positive result of the test carried out in the step S6 will be explained in connection with the process for zero transport capacity. A negative result of the test performed in the step S6 branches to the step S13 and, since the first trip has already been accomplished, branches to the step S19. The door opening time DT.x is started in the step S19, and the loading of the respective elevator car CAR.x is initiated. The iteration procedure of the step S20 checks the instantaneous actual departure load LFB.x and the elapsed door opening time, received from the input/output unit TERMINAL, until the actual departure load equals the corrected total departure load or the door opening time DT.x has elapsed. Then the door closing command DC.x is generated in the step S21 to the elevator control CONTROL.x.

An iteration procedure in the step S22 checks the status variable elevator start CS.x until the value received from the elevator control CONTROL.x is equal to one. With the start of the respective elevator car CAR.x, there occurs in a step S23 the start of the round trip time RT.x and in a step S24 the measurement of the prevailing actual departure load LFB.x. A positive result of the examination carried out in a step 25 indicates that the first trip was completed. A step S26 determines the nominal departure load SL.x based on the specified transport capacity TC.x times the average round trip time ART.x. In a step S27, it is checked whether the nominal departure load SL.x, calculated in the step S26, is less than one elevator passenger. A positive result of the test results in setting the nominal departure load SL.x to one in a step S28, and a reduction of the transport capacity TC.x by one.

The control process performed in a step 29 for the correction of the departure load ASL.x is explained in more detail in the FIG. 6. The previously discussed steps S30 and S31, explained in connection with the first trip, terminate a cycle for the normal operation of the algorithm CONTROLLER.x. A subsequent cycle begins as soon as the respective elevator car CAR.x arrives at the main floor MAIN FLOOR.

A positive result of the test for zero transport capacity in the step S6 initiates a test in a step S7 for passengers in the car. A positive result of the test in the step S7 branches to a step S8 for an iterative examination of the actual departure load LFB.x. If the condition LFB.x=0 is satisfied, there is generated in a step S9 the door closing command DC.x to the elevator control CONTROL.x. In a step S10, the control algorithm shown in the FIG. 6 is initiated and the variable transport capacity TC.x checked subsequently in a step S11. A renewed assignment of the transport capacity starts a step S12. A positive result of the test in the step S12 branches to a step S14 for the calculation of the nominal departure load SL.x based on the transport capacity TC.x times the average round trip time ART.x. A negative result of the test performed in the step S12 branches to the step 15 explained in connection with the first trip. The subsequent steps S16 and S17 correspond to the previously explained steps S27 and S28. The nominal departure load SL.x value, calculated in the step S14 or the step S15, is assigned to the corrected departure load ASL.x in a step S18.

FIG. 5 shows the control algorithm of the superimposed algorithm CONTROLLER and FIG. 6 shows the control algorithm of the subordinated algorithm CONTROLLER.x for readjusting the departure load. These control algorithms are similar in structure. In the sequential steps S1 to S5, the departure load ASL is controlled with a proportional and integral differential control characteristic which is analogous to the integral control characteristic resulting from a differential departure load error and a differential portion calculated on the basis of the differential departure load error, the amplification factor, the time of differentiation and the scanning time. Variations of the control algorithm can include a dead-beat characteristic or a status/observer control characteristic.

A discussion of FIG. 5 follows with FIG. 6 reference symbols in parenthesis. In a step S1, a departure load error SLE (SLE.x) is determined from the difference between the traffic requirement UT (the nominal departure load SL.x) and the actual departure load LFB (LFB.x) In a step S2, a new calculated departure load error CLE (CLE.x) is calculated by adding the departure load error SLE (SLE.x) to an existing calculated departure load error $CLE_{ALT}$($CLE.x_{ALT}$). The calculation of a proportional share PPA (PPA.x) takes place in a step S3 by multiplying the amplification factor GAN (GAN.x) by the departure load error SLE (SLE.x). In a step S4, the calculation of an integral share IPA (IPA.x) is performed by multiplying the amplification factor GAN (GAN.x) times the scanning time ST (ST.x) times the calculated departure load error CLE (CLE.x) and dividing the product by the integration time INT (INT.x). The proportional and integral shares are summed in a step S5 to generate the corrected departure load ASL (ASL.x).

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method for serving building-filling passenger traffic at a main floor of an elevator group having a plurality of elevator cars, comprising the steps of:

a. determining a total transport capacity value according to a first algorithm dependent upon measured building-filling passenger traffic arriving at and departing from a main floor;

b. assigning transport capacities according to said algorithm to a plurality of elevator cars of an elevator group, the sum of all said transport capacities being equal to said total transport capacity value; and c. dispatching each of the elevator cars from the main floor according to a second algorithm based upon said assigned transport capacities, a round trip time for each of the elevator cars, and an actual passenger load.

2. The method according to claim 1 wherein said step a is performed by said first algorithm calculating a difference between a total traffic requirement and a total actual departure load for the elevator group.

3. The method according to claim 2 wherein said total traffic requirement is calculated according to an equation UT=UT.A+UT.B+. . .+UT.N where UT.A is the number of building-filling elevator passengers detected by a first sensor, UT.B is the number of building-filling passengers detected by a second sensor and UT.N is the number of building-filling passengers detected by an N-th sensor, and said total departure load is calculated according to an equation LFB=LFB.1+LFB.2+. . .+LFB.n, where LFB.1 is the actual departure load of a first elevator car, LFB.2 is the actual departure load of a second elevator car and LFB.n is the actual departure load of an n-th elevator car.

4. The method according to claim 1 wherein said first algorithm determines from said total traffic requirement and said total actual departure load a corrected total departure load for the elevator group.

5. The method according to claim 4 wherein said corrected total departure load is controlled with a proportional, an integral and a differential characteristic.

6. The method according to claim 4 wherein said corrected total departure load is controlled with a deadbeat control characteristic.

7. The method according to claim 4 wherein said corrected total departure load is controlled with a status/observer control characteristic.

8. The method according to claim 1 wherein said first algorithm determines said total transport capacity by multiplying said corrected total departure load by a calibrating factor.

9. The method according to claim 8 wherein said total transport capacity is calculated according to an equation TTC=ASL.CG, where ASL is said corrected total departure load and CF is a calibrating factor necessary for the standardization of said total transport capacity.

10. The method according to claim 1 wherein said first algorithm determines said total transport capacity dependent on a calculation utilizing a transport capacity for each respective elevator car.

11. The method according to claim 10 wherein said transport capacity for each respective elevator car is calculated according to an equation $$TC.x = \frac{LS.x \cdot TTC}{LC}$$

where LS.x is a load share dependent on the nominal load of said respective elevator car, TTC is said total transport capacity and LC is a nominal total load of the elevator group.

12. The method according to claim 1 wherein said first algorithm limits, depending on said total transport capacity, the number of elevator cars to which said transport capacity is assigned.

13. The method according to claim 12 wherein at said total transport capacity of at most a predetermined number of elevators, one elevator passenger each is assigned to the number of elevator cars corresponding to said total transport capacity.

14. The method according to claim 12 wherein at said total transport capacity which is greater than a predetermined number of elevators, no transport capacity is assigned to the elevator cars, and a transport capacity smaller than one is assigned to the next elevator car to be dispatched.

15. The method according to claim 1 wherein prerequisites for the incorporation of each respective elevator car into a normal elevator operation are created in a first trip.

16. The method according to claim 15 wherein a subordinated second algorithm controls a first trip of each respective elevator car during which data for the subsequent normal operation is collected.

17. The method according to claim 1 wherein upon no assignment of said transport capacity, said second algorithm controls in a manner which, on a renewed assignment of said transport capacity, said normal operation is resumed.

18. The method according to claim 1 wherein at a nominal departure load of less than one elevator passenger, caused by a small transport capacity value, said second algorithm controls to provide which makes the controlled dispatch of the respective elevator car with one elevator passenger and, after attaining the assigned transport capacity, controls at no assignment of transport capacity.

19. The method according to claim 18 wherein after every dispatch of the respective elevator car with one elevator passenger, the transport capacity of the respective elevator car is reduced by one.

20. The method according to claim 1 wherein said second algorithm determines a round trip time for the respective elevator car and determines an average round trip time for the respective elevator car.

21. The method according to claim 20 wherein said average round trip time for the respective elevator car is calculated according to an equation $$ART.x = \frac{RT.x}{CRT.x}$$

where RT.x is a sum of the previous round trip times and CRT.x is the number of the previous trips of the respective elevator car.

22. The method according to claim 1 wherein said second algorithm determines a nominal departure load for the respective elevator car by multiplying said assigned transport capacity by said average trip time.

23. The method according to claim 22 wherein said nominal departure load for the respective car is calculated according to an equation SL.x=TC.x. ART.x where TC.x is said transport capacity and ART.x is said average round trip time of the respective elevator car.

24. The method according to claim 1 wherein said second algorithm determines a corrected departure load for the respective elevator car from said nominal departure load and said actual departure load.

25. The method according to claim 24 wherein said departure load for the respective elevator car is controlled with a proportional, an integral and a differential control characteristic.

26. The method according to claim 24 wherein said departure load for the respective elevator car is controlled with a dead-beat control characteristic.

27. The method according to claim 1 wherein said second algorithm compares said actual load with said corrected departure load during the loading of the respective elevator car.

28. The method according to claim 27 wherein said departure load for the respective elevator car is controlled with a status/observer control characteristic.

29. The method according to claim 1 wherein said second algorithm generates a door closing command to an elevator control on the loading of the respective elevator car on attaining said corrected departure load or after elapse of a door opening time.

30. The method according to claim 1 wherein said second algorithm remeasures said actual departure load and makes it available for the correction of said departure load and of said total departure load at the departure of the respective elevator car from the main floor.

31. An apparatus for controlling the dispatch of at least one elevator car from a main floor comprising:

a first sensor for generating a first traffic measurement signal representing building-filling passenger traffic arriving at a main floor;

a second sensor for generating a second traffic measurement signal representing building-filling passenger traffic departing at the main floor;

means for storing a first algorithm and for calculating a total transport capacity value based upon said first and second traffic measurement signals and for assigning transport capacities according to said first algorithm to a plurality of elevator cars of an elevator group, the sum of all said transport capacities being equal to said total transport capacity value; and means connected to said means for storing said first algorithm for storing a second algorithm and for dispatching each of the elevator cars from the main floor according to said second algorithm based upon said assigned transport capacities, a round trip time for each of the elevator cars, and an actual passenger load.

32. The apparatus according to claim 31 wherein said means for storing a second algorithm calculates a corrected total departure load based upon the difference between a nominal departure load and the actual departure load, and dispatches the car when the actual departure load equals the corrected total departure load.

33. An apparatus for controlling the dispatch of elevator cars of an elevator group from a main floor comprising:

a call registering device for generating a first traffic measurement signal as a traffic requirement variable representing building-filling passenger traffic arriving at a main floor;

a load measuring device for generating a second traffic measurement signal as an actual departure load variable representing building-filling passenger traffic departing at the main floor;

means connected to said call registering device and to said load measuring device for storing a first algorithm and for calculating a total transport capacity for an elevator system from said first and second signals and for calculating transport capacities for each elevator car of said system, the sum of said transport capacities being equal to said total transport capacity; and means connected between said means for storing said first algorithm and a control for the elevator cars for storing a second algorithm and for calculating a corrected total departure load for each elevator car based upon the associated one of said transport capacities, and for generating a door closing command to the control when the actual value of a departure load for each elevator car equals said corrected total departure load.

* * * * *